US006925376B2

(12) United States Patent
Li et al.

(10) Patent No.: US 6,925,376 B2
(45) Date of Patent: Aug. 2, 2005

(54) SYSTEM FOR DIAGNOSING OPERATION OF A COOLING SYSTEM FOR AN INTERNAL COMBUSTION ENGINE

(75) Inventors: Xiaoqiu Li, Columbus, IN (US); Todd C. Slater, Columbus, IN (US); Mark R. Stepper, Columbus, IN (US); Anthony J. Abbenante, New Smyrna Beach, FL (US); Stephanie L. Goerges, Franklin, IN (US); Yue Yun Wang, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 102 days.

(21) Appl. No.: 10/404,757

(22) Filed: Apr. 1, 2003

(65) Prior Publication Data

US 2004/0199324 A1 Oct. 7, 2004

(51) Int. Cl.[7] ..... G60G 7/70

(52) U.S. Cl. ..... 701/114; 701/102; 73/118.1; 73/117.3; 60/605.2; 123/339.24; 123/361; 123/677; 123/686; 123/568.12

(58) Field of Search ..... 701/114, 102; 123/568.12, 41.01–41.21, 677, 678, 686, 689, 361, 339.24; 73/118.1; 60/605.2

(56) References Cited

U.S. PATENT DOCUMENTS

| | | | | |
|---|---|---|---|---|
| 4,069,712 A | | 1/1978 | Armstrong et al. | 73/118.1 |
| 5,303,168 A | | 4/1994 | Cullen et al. | 364/557 |
| 5,386,373 A | | 1/1995 | Keeler et al. | 364/577 |
| 5,539,638 A | | 7/1996 | Keeler et al. | 364/424.03 |
| 5,548,528 A | | 8/1996 | Keeler et al. | 364/497 |
| 5,582,138 A | | 12/1996 | Ziolek et al. | 123/41.1 |
| 5,656,771 A | | 8/1997 | Beswick et al. | 73/118.1 |
| 5,682,317 A | | 10/1997 | Keeler et al. | 364/431.03 |
| 5,692,460 A | | 12/1997 | Froeschl et al. | 123/41.1 |
| 5,855,111 A | | 1/1999 | Oguchi et al. | 60/39.5 |
| 5,880,361 A | | 3/1999 | Taniguchi | 73/118.1 |
| 5,971,888 A | | 10/1999 | Goode | 477/107 |
| 6,200,021 B1 | | 3/2001 | Mitsutani et al. | 374/1 |
| 6,236,908 B1 | | 5/2001 | Cheng et al. | 701/1 |
| 6,240,774 B1 | | 6/2001 | Niki et al. | 73/118.1 |
| 6,279,390 B1 | | 8/2001 | Oka et al. | 73/118.1 |
| 6,308,124 B1 | * | 10/2001 | Kresse et al. | 701/53 |
| 6,321,695 B1 | | 11/2001 | Yoo et al. | 123/41.15 |
| 6,484,686 B1 | * | 11/2002 | Ordanic | 123/198 F |
| 6,725,847 B2 | * | 4/2004 | Brunemann et al. | 123/568.12 |

* cited by examiner

*Primary Examiner*—Tony M. Argenbright
*Assistant Examiner*—Johnny H. Hoang
(74) *Attorney, Agent, or Firm*—Barnes & Thornburg

(57) ABSTRACT

A system for diagnosing operation of a cooling system for an internal combustion engine includes a coolant temperature sensor producing a temperature signal corresponding to coolant fluid temperature, means for determining either an engine load or a throttle percentage, and a control computer configured to diagnose operation of the cooling system as a function of the temperature signal, either the engine load or throttle percentage, and a fuel delivery command for controllably supplying fuel to the engine. After expiration of a diagnostic period, the control computer diagnoses the cooling system as normally operating if the diagnostic period ended by the temperature signal meeting or exceeding a predefined temperature and if a total energy used by the engine during the diagnostic period is less than an estimated energy, and diagnoses the cooling system as failing if the total energy used during the diagnostic period otherwise meets or exceeds the estimated energy.

29 Claims, 4 Drawing Sheets

SYSTEM FOR DIAGNOSING OPERATION OF A COOLING SYSTEM FOR AN INTERNAL COMBUSTION ENGINE

FIELD OF THE INVENTION

The present invention relates generally to systems for monitoring the operation of a cooling system for an internal combustion engine, and more specifically to systems for diagnosing engine cooling system operation.

BACKGROUND OF THE INVENTION

Thermostats for internal combustion engines are known, and are generally operable to control the flow of coolant fluid through the engine and associated engine cooling system based on coolant fluid temperature. Conventional thermostats have a closed position for inhibiting the flow of coolant fluid through the engine cooling system, and an open position for allowing the flow of coolant fluid through the engine cooling system. Such thermostats are typically closed as long as the temperature of the coolant fluid is below a specified closing temperature, and are open as long as the temperature of the coolant fluid is above a specified opening temperature. The specified closing and opening temperatures may or may not be equal.

It is desirable to monitor the operation of the engine cooling system to determine whether it is operating normally or if the thermostat has failed. What is therefore needed is a system for diagnosing the operation of an engine cooling system to determine its current operational state and detect thermostat fault or failure conditions as they may occur.

SUMMARY OF THE INVENTION

The present invention may comprise one or more of the following features and combinations thereof. A system for diagnosing operation of a cooling system for an internal combustion engine comprises a coolant temperature sensor producing a coolant temperature signal corresponding to temperature of coolant fluid in the cooling system, means for determining one of an engine load and a throttle percentage, and a control computer. The control computer may be configured to diagnose operation of the cooling system as a function of the coolant temperature signal, the engine load or throttle percentage and a fuel delivery command for controllably supplying fuel to the engine.

The system may further include a key switch for starting and stopping the engine, and the control computer may be configured to monitor the coolant temperature signal to determine an initial coolant temperature when the key switch switches from an off to an on position.

The control computer may further be configured to determine an estimated energy as a function of the initial coolant temperature, wherein the estimated energy corresponds to an estimated quantity of energy required to increase the initial coolant temperature to a predefined higher coolant temperature.

The control computer may further be configured to determine an initial count value of a diagnostic counter as a function of the initial coolant temperature.

The system may further include means for determining an operating status of the engine and producing an engine operating status signal corresponding thereto, and the control computer may be responsive to the engine operating status signal indicating that the engine is running to begin a diagnostic period by determining a current value of the engine load as a function of the fuel delivery command or the throttle percentage as a function of a requested torque value, determining a counter decrement rate as a function of the current value of the engine load or throttle percentage and decrementing the diagnostic counter from the initial count value at the counter decrement rate.

The control computer may further be configured to continually monitor the coolant temperature signal, determine the current value of the engine load or throttle percentage, determine the counter decrement rate as the function of the current value of the engine load or throttle percentage, and decrement the diagnostic counter at the counter decrement rate until the diagnostic period ends by either of the coolant temperature signal meeting or exceeding the predefined coolant temperature and the diagnostic counter reaching zero.

The control computer may further be configured to determine as a function of the fuel delivery command a total energy used by the engine during the diagnostic period.

The control computer may further be configured to diagnose the cooling system, after expiration of the diagnostic period, as normally operating if the diagnostic period ended by the coolant temperature signal meeting or exceeding the predefined coolant temperature and if the total energy used by the engine during the diagnostic period is less than the estimated energy. The control computer may further be configured to diagnose the cooling system as failing if the total energy used by the engine during the diagnostic period otherwise meets or exceeds the estimated energy. The cooling system may include a thermostat having an open position allowing circulation of the coolant fluid therethrough, and a closed position inhibiting circulation of the coolant fluid therethrough, and the control computer may be configured to diagnose the cooling system as failing by diagnosing the thermostat as a failed thermostat. The control computer may further be configured to diagnose the cooling system as the failing only if no do-not-log fault conditions exist. The control computer may further be configured to otherwise abort diagnosis of the cooling system if any of the do-not-log fault conditions exist.

Additionally or alternatively, the control computer may further be configured to determine a minimum energy as a function of the initial coolant fluid temperature, the minimum energy corresponding to a predicted quantity of energy that will be used by the engine if the engine runs at an idle speed during for an extended portion of the diagnostic period. The control computer may be configured to diagnose the cooling system, after expiration of the diagnostic period, as failing if the diagnostic period ended by the diagnostic counter reaching zero and if the total energy used by the engine during the diagnostic meets or exceeds the minimum energy. The cooling system may further include a thermostat having an open position allowing circulation of the coolant fluid therethrough, and a closed position inhibiting circulation of the coolant fluid therethrough, and the control computer may be configured to diagnose the cooling system as failing by diagnosing the thermostat as a failed thermostat. The control computer may further be configured to abort diagnosis of the cooling system if the total energy is otherwise less than the minimum energy. The control computer may further be configured to diagnose the cooling system as the failing only if no do-not-log fault conditions exist. The control computer may further be configured to otherwise abort diagnosis of the cooling system if any of the do-not-log fault conditions exist.

The control computer may be configured to be responsive to the key switch switching from the off to the on position to monitor a number of operating parameters associated with the engine, and to abort diagnosis of the cooling system if any of the number of operating parameters associated with the engine are indicative of a diagnostic aborting condition.

The control computer may further be configured to continually monitor a number of operating parameters associated with the engine, and to abort diagnosis of the cooling system if any of the number of operating parameters associated with the engine are indicative of a diagnostic aborting condition.

Alternatively or additionally, a system may be provided for diagnosing operation of a cooling system for an internal combustion engine, wherein the system comprises means for determining a temperature of coolant fluid in the cooling system, means for determining an estimated energy as a function of an initial value of the temperature of the coolant fluid prior to a diagnostic period, the estimated energy corresponding to an estimated quantity of energy required to increase the temperature of the coolant fluid from the initial value to a predefined higher temperature value, means for determining a total energy as a function of fuel quantity delivered to the engine during the diagnostic period, the total energy corresponding to a total quantity of energy used by the engine during the diagnostic period, and means for diagnosing the cooling system as operating normally if, after expiration of the diagnostic period, the temperature of the coolant fluid meets or exceeds the predefined temperature value and the total energy is less than the estimated energy. The system may further include means for diagnosing the cooling system as a failing if, after expiration of the diagnostic period, the total energy otherwise meets or exceeds the estimated energy and no do-not-log fault conditions exist. The cooling system may include a thermostat having an open position allowing circulation of the coolant fluid therethrough, and a closed position inhibiting circulation of the coolant fluid therethrough, and the means for diagnosing the cooling system as failing may further include means for diagnosing the thermostat as a failed thermostat. The system may further include means for aborting diagnosis of the cooling system if, after expiration of the diagnostic period, the total energy otherwise meets or exceeds the estimated energy and at least one do-not-log fault condition exists. The system may further include means for determining an initial count value of a counter as a function of the initial value of the temperature of the coolant fluid, means responsive to detection that the engine is running to start the diagnostic period, means for continually monitoring the temperature of the coolant fluid, determining a current value of one of engine load as a function of engine fueling and a throttle percentage as a function of a driver requested torque value, determining a counter decrement rate as a function of the current value of the one of engine load and throttle percentage, and decrementing the counter at the counter decrement rate, and means for ending the diagnostic period if either of the temperature of the coolant fluid meets or exceeds the predefined temperature value and the counter reaches zero.

Alternatively or additionally, a system may be provided for diagnosing operation of an engine cooling system for an internal combustion engine, wherein the system comprises means for determining a temperature of coolant fluid in the cooling system, means for determining a minimum energy as a function of an initial value of the temperature of the coolant fluid prior to a diagnostic period, the minimum energy corresponding to a predicted quantity of energy that will be used by the engine if the engine runs at an idle speed for an extended portion of the diagnostic period, means for determining a total energy as a function of fuel quantity delivered to the engine during the diagnostic period, the total energy corresponding to a total quantity of energy used by the engine during the diagnostic period, and means for diagnosing the cooling system as a failing if, after expiration of the diagnostic period, the temperature of the coolant fluid is below a threshold temperature and the total energy meets or exceeds the minimum energy. The cooling system may further include a thermostat having an open position allowing circulation of the coolant fluid therethrough, and a closed position inhibiting circulation of the coolant fluid therethrough, and the means for diagnosing the cooling system as failing includes means for diagnosing the thermostat as a failed thermostat. The system may further include means for otherwise aborting diagnosis of the engine cooling system if, after expiration of the diagnostic period, the total energy is less than the minimum energy. The system may further include means for aborting diagnosis of the cooling system if, after expiration of the diagnostic period, at least one do-not-log fault condition exists. The system may further include means for determining an initial count value of a counter as a function of the initial value of the temperature of the coolant fluid, means responsive to detection that the engine is running to start the diagnostic period, and means for continually monitoring the temperature of the coolant fluid, determining a current value of the engine load as a function of engine fueling or throttle percentage as a function of a driver requested torque value, determining a counter decrement rate as a function of the current value of the engine load or throttle percentage, and decrementing the counter at the counter decrement rate, and means for ending the diagnostic period if either of the temperature of the coolant fluid meets or exceeds a predefined temperature value and the counter reaches zero.

These and other objects of the present invention will become more apparent from the following description of the illustrative embodiment.

DESCRIPTION OF THE ILLUSTRATIVE EMBODIMENT

Figure 1:
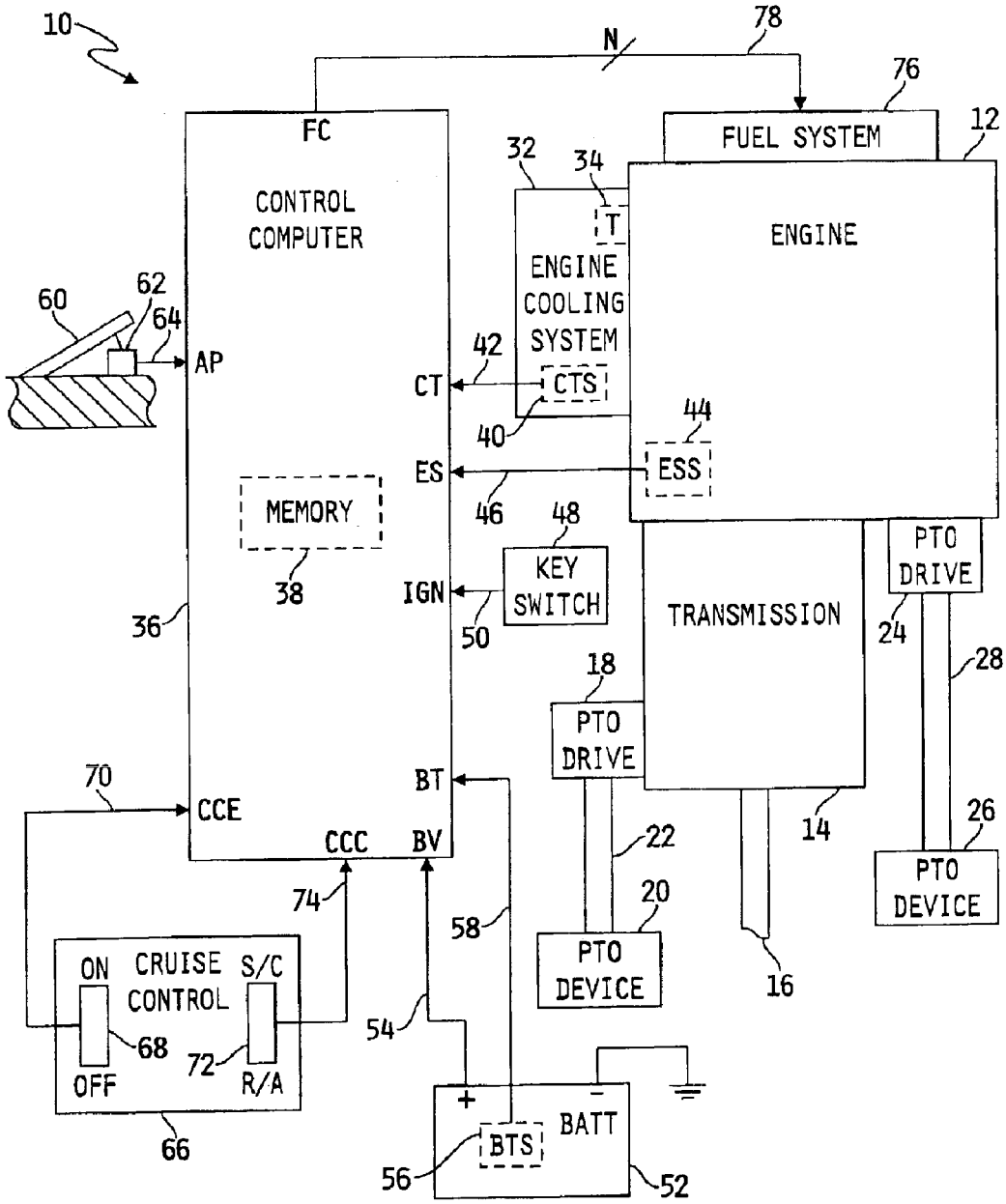
FIG. 1 is a diagram of one illustrative embodiment of an electronic system for diagnosing operation of an engine cooling system.

For the purposes of promoting an understanding of the principles of the invention, reference will now be made to an illustrative embodiment shown in the drawings and specific language will be used to describe the same. It will nevertheless be understood that no limitation of the scope of the invention is thereby intended.

Referring now to FIG. 1, a diagram of one illustrative embodiment of an electronic system 10 for diagnosing operation of an engine cooling system is shown. System 10 includes an internal combustion engine 12 operatively coupled to a transmission 14 that is operatively coupled to a propeller or drive shaft 16. The transmission 14 may have a power take off (PTO) drive mechanism 18 operatively coupled thereto, wherein PTO drive mechanism 18 is operatively coupled to a drive shaft 22 configured for coupling to a PTO device 20. Alternatively or additionally, engine 12 may have another PTO drive mechanism 24 operatively coupled thereto, wherein PTO drive mechanism 24 is operatively coupled to a drive shaft 28 configured for coupling to a PTO device 26. PTO devices 20 or 26 may be any known machinery and/or mechanism configured to be driven by a conventional PTO drive mechanism.

Engine 12 further includes a conventional engine cooling system 32. As is known in the art, cooling system 32 defines a fluid flow path through engine 12, and coolant fluid carried by the cooling system 32 circulates through the engine 12 and the cooling system 32 to cool the engine 12 during operation thereof. Cooling system 32 includes a conventional thermostat 34 disposed in the fluid flow path, wherein the thermostat 34 is configured in a conventional manner to open and close at predefined opening and closing temperatures. The thermostat 34 is operable in its closed position to block or inhibit the circulation of coolant fluid through the cooling system 32 as long as the temperature of the coolant fluid is below the thermostat closing temperature. When the temperature of the coolant fluid is at or above the thermostat opening temperature, the thermostat 34 opens to allow the coolant fluid to circulate through the cooling system 32. The thermostat opening and closing temperatures may be substantially equal, or may alternatively be offset to provide for some amount of thermostat opening/closing hysteresis.

System 10 includes a control computer 36 that is, in one embodiment, generally operable to control and manage the overall operation of engine 12. Control computer 36 includes a memory unit 38 as well as a number of inputs and outputs for interfacing with various sensors and systems coupled to engine 12. Control computer 36 is, in one embodiment, microprocessor-based and may be a known control unit sometimes referred to as an electronic or engine control module (ECM), electronic or engine control unit (ECU) or the like, or may alternatively be a general purpose control circuit capable of operation as will be described hereinafter. In any case, control computer 36 includes one or more control algorithms, as will be described in greater detail hereinafter, for diagnosing operation of the cooling system 32.

Control computer 36 includes a number of inputs for receiving signals from various sensors or sensing systems associated with system 10. For example, system 10 includes a coolant temperature sensor 40 (CTS) disposed in fluid communication with the coolant fluid carried by the engine cooling system 32 and electrically connected to a coolant temperature input, CT, of control computer 36 via signal path 42. Coolant temperature sensor 40 may be of known construction, and is operable to produce a temperature signal on signal path 42 indicative of the temperature of the coolant fluid within the engine cooling system 32.

System 10 further includes an engine speed sensor 44 (ESS) electrically connected to an engine speed input, ES, of control computer 36 via signal path 46. Engine speed sensor 44 is operable to sense rotational speed of the engine 12 and produce an engine speed signal on signal path 46 indicative of engine rotational speed. In one embodiment, sensor 44 is a Hall effect sensor operable to determine engine speed by sensing passage thereby of a number of equi-angularly spaced teeth formed on a gear or tone wheel. Alternatively, engine speed sensor 44 may be any other known sensor operable as just described including, but not limited to, a variable reluctance sensor or the like.

System 10 further includes a key switch 48 electrically connected to an ignition input, IGN, of control computer 36 via signal path 50. Ignition switch 48 may be of known construction and has three switch positions; "off", "on" and "crank." As is known in the art, system power is applied to control computer 36 and other subsystems within system 10 when the ignition switch 48 is switched from the "off" position to the "on" position, and the engine starting system (not shown) is activated when the ignition switch 48 is switched from the "on" to the "crank" position.

System 10 further includes a vehicle battery 52 operatively connected to a battery voltage input, BV, of control computer 36 via signal path 54. The control computer 36 is operable to monitor the voltage level produced by the vehicle battery 52 by monitoring the voltage on signal path 54. The battery 52 includes a battery temperature sensor 56 (BTS) electrically connected to a battery temperature input, BT, of control computer 36 via signal path 58. Battery temperature sensor 56 may be of known construction, and is operable to produce a temperature signal on signal path 58 indicative of the operating temperature of the vehicle battery 52.

System 10 further includes an accelerator pedal 60 operatively coupled to an accelerator pedal position sensor 62 that is electrically connected to an accelerator pedal input, AP, of control computer 36 via signal path 64. Sensor 62 may be of known construction and is operable to produce an accelerator pedal signal on signal path 64 that is indicative of accelerator pedal position or deflection relative to a reference position.

System 10 further includes a cruise control unit 66 of known construction and having an on/off switch 68 electrically connected to a cruise control enable input, CCE, of control computer 36 via signal path 70. A set/coast (S/C) and resume/accelerate (R/A) switch 72 is connected to a cruise control operation input (CCO) of control computer 36 via signal path 74. Control computer 36 is responsive to cruise control unit 66 in a conventional manner in that if on/off switch 68 is in the "off" position, control computer 36 is operable to disregard signals produced by switch 72 on signal path 74. If the on/off switch 68 is conversely in the "on" position, control computer 36 is responsive to the set/coast and/or resume/accel signals produced by switch 72 to achieve and maintain a desired vehicle speed. Below a specified vehicle speed, the cruise control unit 66 may be operable as just described in a so-called power take off (PTO) mode, wherein cruise control unit 66 is operable to maintain a desired engine speed.

System 10 further includes a fuel system 76 electrically connected to a fuel control output, FC, of control computer 36 via a number, N, of signal paths 78 wherein N may be any positive integer. Fuel system 76 is responsive to fuel control signals produced by control computer 36 at output FC to deliver fuel to engine 12 in a known manner. Control computer 36 is responsive in a conventional manner to a number of engine operating conditions, such as the engine speed signal on signal path 46, one or more torque request signals, and the like, to determine fuel delivery commands, and to then process such fuel delivery commands to produce corresponding fuel control signals at output FC on signal paths 78. The one or more torque request signals may be provided by the accelerator pedal position sensor 62 or the cruise control unit 66, wherein the torque request value or signal may alternatively referred to hereinafter generally as a throttle percentage. Torque requests or torque limiting requests may further be provided by other control systems external to control computer 36 and/or one or more control algorithms executable by control computer 36. In any case, control computer 36 is responsive to any one or combination of such torque and/or torque limiting requests to produce appropriate fueling commands, FC.

Figure 2A:
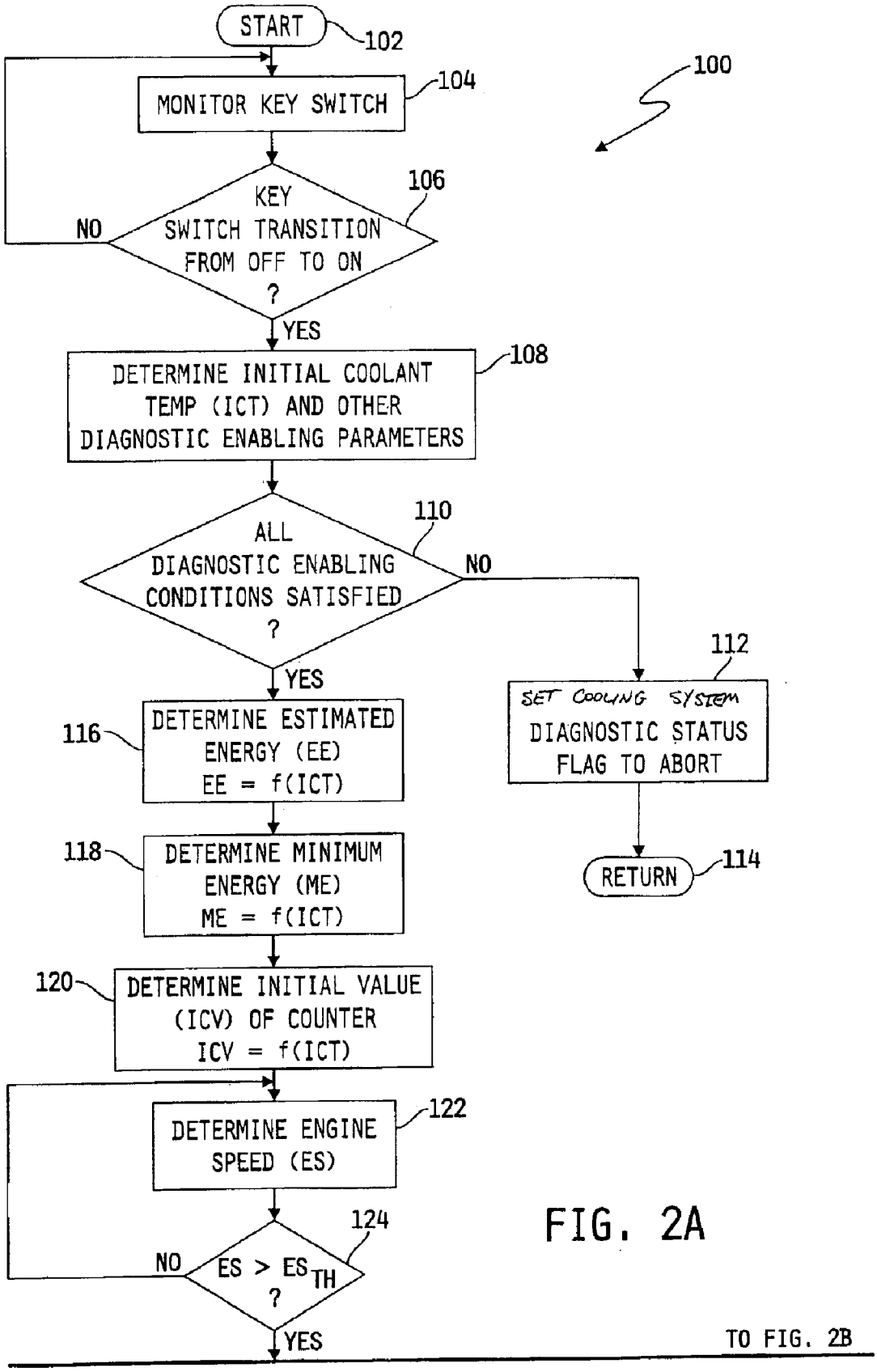
FIGS. 2A–2C represent a flowchart of one illustrative embodiment of a software algorithm for diagnosing operation of an engine cooling system using the electronic system illustrated in FIG. 1.
Figure 2B:
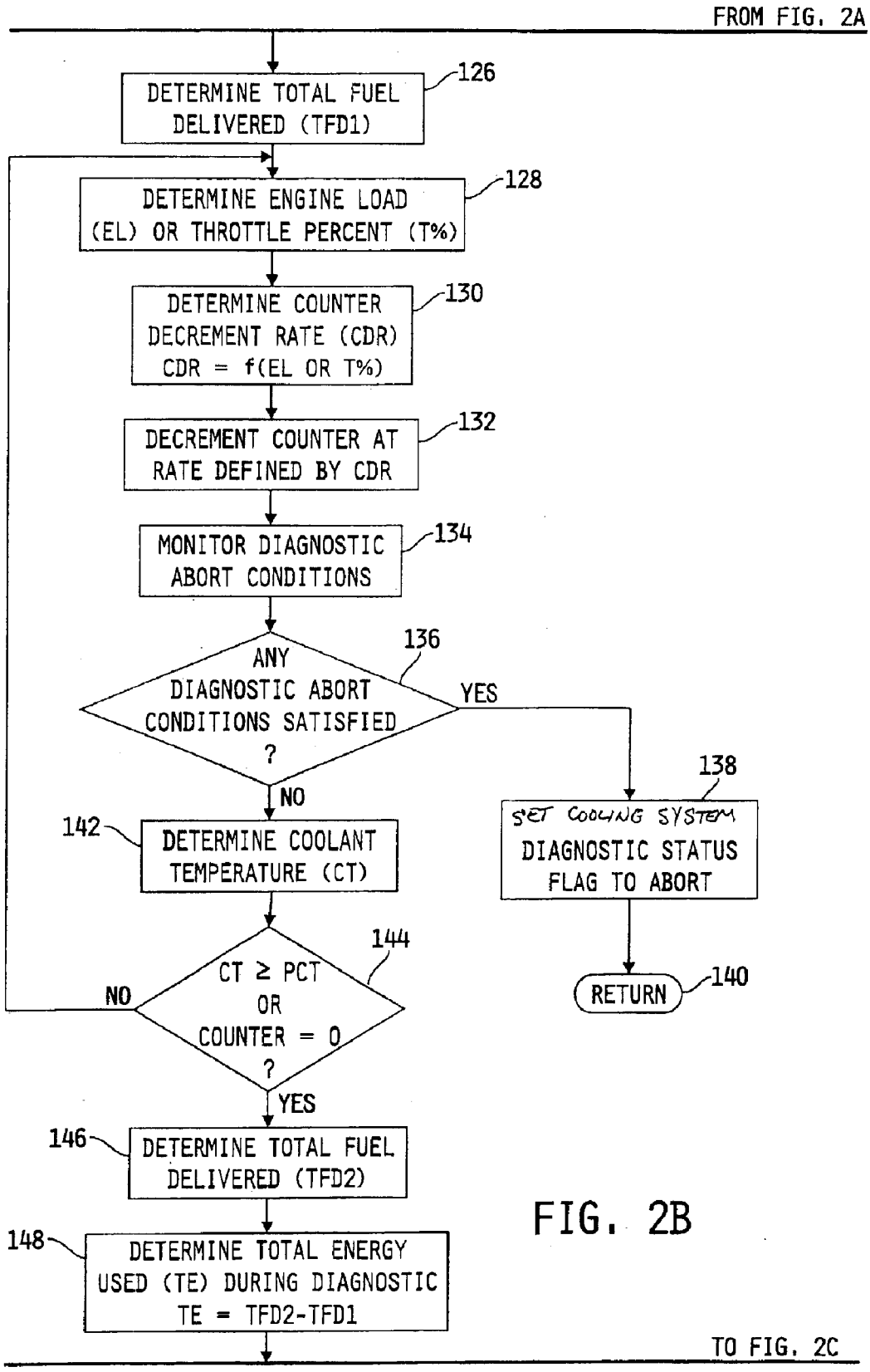
Figure 2C:
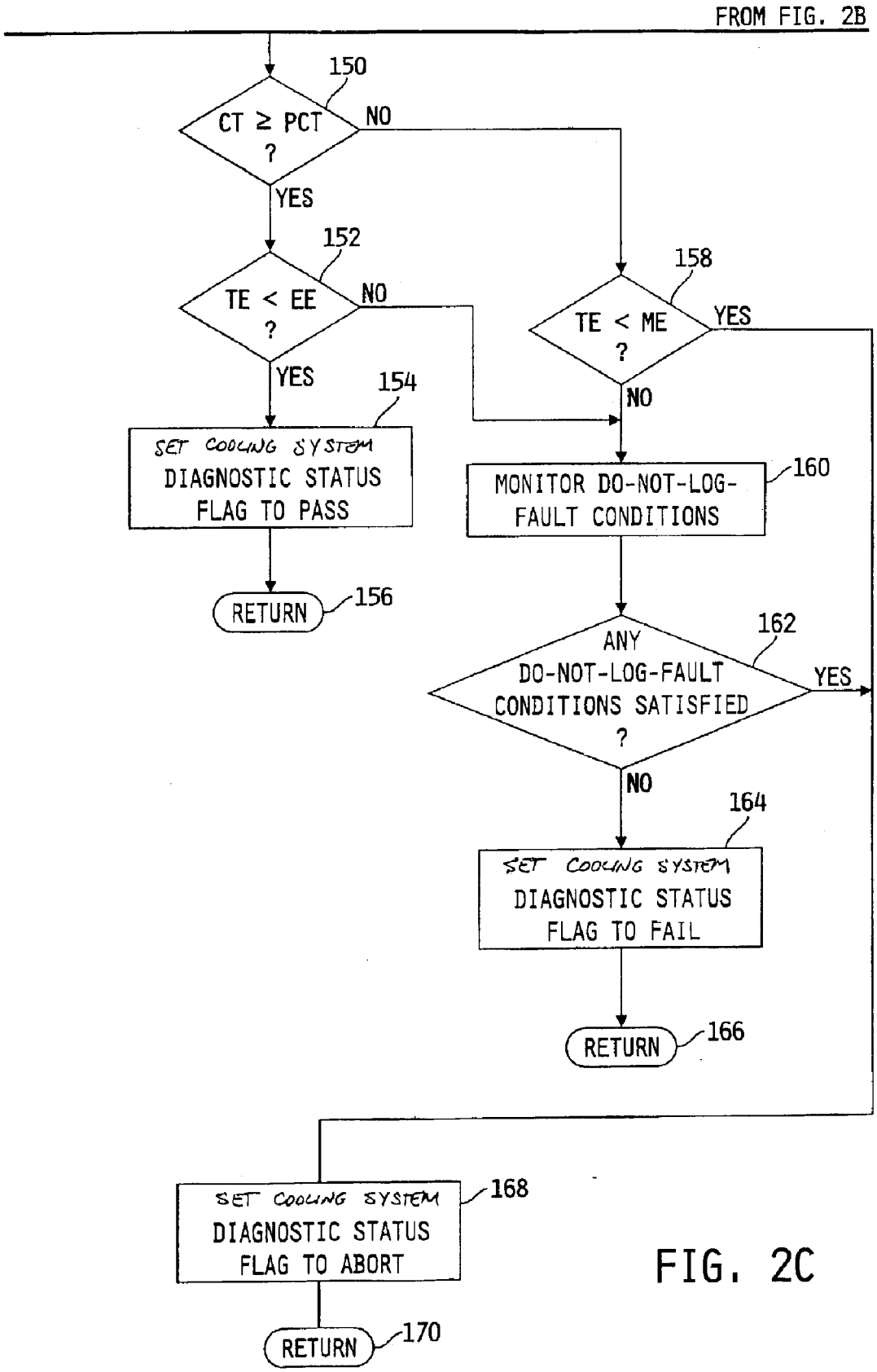

Referring now to FIGS. 2A–2C, a flowchart is shown illustrating one embodiment of a software algorithm 100 for diagnosing operation of the engine cooling system 32 using the electronic system 10 illustrated in FIG. 1. Algorithm 100 may be stored in memory 38, and is in any case executed by control computer 36. Algorithm 100 begins at step 102, and thereafter at step 104 control computer 36 is operable to monitor the key switch 48. Thereafter at step 106, control computer 36 is operable to determine whether the key switch 48 has switched or transitioned from its "off" position to its "on" position. If not, algorithm execution loops back to step 104. If, on the other hand, control computer 36 determines at step 106 that the key switch 48 has switched from its "off" position to its "on" position, then control computer 36 is thereafter operable at step 108 to determine an initial coolant temperature, ICT, as well as other diagnostic enabling parameters. In one embodiment, control computer 36 is operable at step 108 to determine the initial coolant temperature value, ICT, by monitoring the signal produced by the coolant temperature sensor 40.

Following step 108, control computer 36 is operable at step 110 to determine whether all diagnostic enabling conditions have been satisfied by comparing the diagnostic enabling parameters determined at step 108 to predefined operating conditions. In one embodiment, control computer 36 is operable at step 108 to monitor two diagnostic enabling parameters; initial coolant temperature and an engine operating state. The initial coolant temperature is, as just described, provided by the coolant temperature sensor 40. Control computer 36 may be configured to determine the engine operating state by monitoring any one or more engine operating parameters, such as engine speed, engine fueling, boost pressure, ignition system operation, or the like, and in one embodiment control computer 36 maintains internal thereto an engine operating state flag or identifier that is instantaneously indicative of the operating state of the engine 12. In a conventional manner, control computer 36 is operable to determine the operating state of the engine 12 to control the status of the engine operating state indicator to reflect the current operating state of the engine 12; e.g., "run" or "stop". In any case, if, at step 110, control computer 36 determines that the engine operating state is "stop" and that the initial coolant temperature is within a predefined range; e.g., 20° F.<ICT<130° F., then algorithm execution advances to step 116. If, on the other hand, control computer 36 determines either that the engine operating state is "run" or that the initial coolant temperature is outside of the predefined temperature range, algorithm execution advances to step 112 where control computer 36 is operable to abort the diagnosis of the engine cooling system 32 by setting the cooling system diagnostic status flag to ABORT, and thereafter at step 114 to return algorithm 100 to its calling routine. It is desirable to choose the predefined range of the initial coolant temperature, ICT, such that the initial coolant temperature is warm enough to provide a reasonable expectation of increasing, under typical engine operating conditions, to a normally operating engine temperature value within the diagnostic test period, and is also sufficiently below a normal engine running temperature to allow the thermostat to close. Those skilled in the art will recognize that the predefined temperature range of the initial coolant temperature may thus vary, and its upper and lower limits will typically be dictated by the particular application. Those skilled in the art will further recognize that algorithm 100 may be easily modified to implement more or fewer diagnostic enabling parameters and conditions, and any such modifications are intended to fall within the scope of the claims appended hereto.

If control computer 36 determines at step 110 that all diagnostic enabling conditions are satisfied, algorithm execution advances to step 116 where control computer 36 is operable to determine an estimated energy value, EE, as a function of the initial coolant temperature, ICT. Generally, the estimated energy value, EE, is an estimation of the energy required to increase the coolant temperature from its initial temperature, ICT, to a predefined coolant temperature. It has been determined through theoretical analysis and experimentation that the rise in coolant temperature, CTR, is directly proportional to the total energy used by the engine 12 during the coolant temperature rise, wherein the total energy used by engine 12 is equal to the total fuel delivered to the engine 12 during the coolant temperature rise. This relationship between engine fueling and coolant temperature rise can be expressed by the following equation:

$$CTR=a*TFD \quad (1),$$

where,

CTR is the amount of rise in coolant temperature,

TFD is the total fuel delivered to the engine 12 during the coolant temperature rise, and "a" is a calibratible constant determined for any specific engine configuration through experimentation.

Based on equation (1), the total energy required to raise the coolant temperature from an initial coolant temperature, ICT, to a predefined coolant temperature, PCT, greater than ICT can be estimated according to the following equation:

$$EE=(PCT-ICT)/a \quad (2),$$

where,

EE is the estimated energy,

PCT is the predefined coolant temperature,

ICT is the initial coolant temperature, and

"a" is the calibratible constant from equation (1).

In one illustrative embodiment, control computer 36 is thus operable to execute step 116 by determining the estimated energy, EE, according to equation (2). It is desirable for the predefined coolant temperature, PCT, to be a temperature indicative of a warm and running engine with the thermostat 34 in its open position. In one illustrative embodiment, for example, the predefined coolant temperature, PCT, is set to 170° F. in equation (2), although those skilled in the art will recognize that any particular value of the predefined coolant temperature will typically be dictated by the application.

Following step 116, algorithm execution advances to step 118 where control computer 36 is operable to determine a minimum energy, ME, again as a function of the initial coolant temperature, ICT. It is generally understood that at engine idling speeds, the engine operating temperature, and hence the coolant fluid temperature, will not rise as quickly as it would otherwise under higher engine speeds and engine loads. It is accordingly desirable to abort diagnosis of the cooling system 32 under extended idle drive cycles, and the minimum energy parameter, ME, is included within algorithm 100 to provide an estimation or prediction, relative to the initial coolant temperature value, ICT, of the quantity of energy that would be used by the engine 12 under such extended engine idling activity during diagnosis of the engine cooling system 32. The minimum energy, ME, thus corresponds to a predicted quantity of energy that will be used by the engine 12 if the engine 12 runs at an idle speed during for an extended portion of the diagnostic period, wherein this minimum energy value, ME, varies as a function of the initial coolant temperature, ICT. The minimum energy function may be implemented in control computer 36 in the form of one or more mathematical equations, charts, graphs, tables or the like, and in one illustrative embodiment it is implemented as a table of minimum energy values, ME, as a function of initial coolant temperature, ICT.

In one illustrative embodiment, the minimum energy table is calibrated between a "highest energy" for extended idle drive cycles and a "lowest energy" for non-extended idle drive cycles. The "highest energy" for extended drive cycle case may include, for example, a poorly performing "good" thermostat 34 having a high leakage rate, e.g., 100 cc/min, an idle duration of greater than 50% of the diagnostic monitoring time, low average engine load, e.g., <16%, cab heater on full with all windows open at least 2 inches. The "lowest energy" for non-extended idle drive cycle case may include, for example, a normally performing thermostat 34, a long idle duration, but less than 50% of the diagnostic monitoring time, cab heater off and a low average engine load, 16–20% In this embodiment, the minimum energy table is calibrated between the "highest energy" case and the "lowest energy" case, as a function of the initial coolant temperature, ICT.

Following step 118, algorithm execution advances to step 120 where control computer 36 is operable to determine an initial value (ICV) of a diagnostic counter as a function of the initial coolant temperature, ICT. The initial value of the diagnostic counter, ICV, determines, in part, the duration of the engine cooling system diagnostic period. It is generally understood that the length of time required for engine 12 to warm up will vary based on its initial temperature, and the initial value of the diagnostic counter, ICV, is accordingly determined by control computer 36 at step 120 as a function of the initial coolant temperature, ICT. Determination of the initial value, ICV, of the diagnostic counter may be implemented in control computer 36 in the form of one or more mathematical equations, charts, graphs, tables or the like, and in one illustrative embodiment it is implemented as a table of initial values, ICV, of the diagnostic counter as a function of initial coolant temperature, ICT.

In one illustrative embodiment, the table of initial values, ICV, of the diagnostic counter is calibrated based on a test case for a "longest, non-extended idle warm-up" time to the predefined coolant temperature, PCT (see equation (2) above). This test case may include, for example, a poorly performing "good" thermostat 34 having a high leakage rate, e.g., 100 cc/min, a long idle duration, but less than 50% of the diagnostic monitoring time, low average engine load, e.g., <16–20% and cab heater on full with all windows open at least 2 inches. It is desirable to run this test case from a number of different initial coolant temperatures, ICT, e.g., 20° F., 70° F. and 130° F., and record the warm-up times to the predefined coolant temperature, e.g., 170° F. In this embodiment, the initial counter value table is calibrated based on the recorded warm-up times, as a function of the initial coolant temperature, ICT.

Following step 120, algorithm 100 advances to step 122 where control computer 36 is operable to determine engine speed via engine speed sensor 44, and thereafter at step 124 to determine whether the engine speed value determined at step 122 is greater than an engine speed threshold, $ES_{TH}$. If not, algorithm execution loops back to step 122, and if control computer 36 determines at step 124 that engine speed is greater than $ES_{TH}$, algorithm execution advances to step 126. Steps 122 and 124 are included to determine whether, following key switch "on", the engine 12 has subsequently been started and is running, and the engine speed threshold, $ES_{TH}$, is accordingly selected as an engine speed value above which engine 12 is considered to be running. Those skilled in the art will recognize other known techniques for determining whether engine 12 is running, wherein such other known techniques may include monitoring one or more alternative or additional engine operating parameters including, for example, engine fueling, boost pressure, ignition system operation, and the like, or may alternatively still include monitoring an internally generated engine operational status flag or indicator as described hereinabove. Any such alternate techniques for determining whether engine 12 is running may be substituted or added to steps 122 and 124, and are in any case intended to fall within the scope of the claims appended hereto.

Referring now to FIG. 2B, control computer 36 is operable at step 126 to determine the total fuel delivered, TFD1, prior to beginning the engine cooling system diagnostic period beginning with step 128. In one illustrative embodiment, control computer 36 is operable in a conventional manner to maintain an accumulated value of the total fuel delivered (TFD) to the engine during any one engine operating cycle, based on the fuel delivery commands. In this embodiment, control computer 36 is operable to determine the total fuel delivered during the engine cooling system diagnostic period beginning with step 128 by recording at step 126 the total fuel delivered since the engine 12 was started (TFD1), and then by subtracting this value from the accumulated total fuel delivered parameter after the cooling system diagnostic period has ended, as will be described in greater detail hereinafter with respect to steps 146 and 148.

Following step 126, the engine cooling system diagnostic period begins at step 128 where control computer 36 is operable to determine either an engine load value, EL, or a throttle percentage value, T%. In one embodiment, control computer 36 is operable to determine an engine load value, EL, as a known function of the fuel delivery commands. Alternatively, control computer 36 is operable at step 128 to determine a throttle percentage value, T%, as a known function of the driver requested torque value. In this embodiment, T% corresponds to the accelerator pedal position or percentage under manual fuel control, and to the driver requested torque percentage under cruise control. In any case, the engine load value, EL, provides an instantaneous measure of the relative level of work being performed by engine 12, and the throttle percentage value, T%, provides a similar measure of engine work.

Thereafter at step 130, control computer 36 is operable to determine a counter decrement rate, CDR, as a function of either the engine load value, EL, or the throttle percentage value, T%, determined at step 128. The counter decrement rate, CDR, along with the initial counter value, ICV, described hereinabove define the maximum duration of the engine cooling system diagnostic period beginning with the first execution of step 128. From its initial counter value, ICV, the diagnostic counter decrements at a rate defined by the counter decrement rate, CDR, wherein CDR is updated as a function of EL or T% each execution of the engine cooling system diagnostic loop defined by algorithm steps 128–144. Experimental results indicate that the rate of engine warm-up from any initial coolant temperature value increases with increasing engine load, EL, (or throttle percentage, T%). The counter decrement rate, CDR, is inversely proportional to engine load, EL, or throttle percentage, T%, such that CDR decreases with increasing engine load, EL, or throttle percentage, T%. Determination of the counter decrement rate, CDR, may be implemented in control computer 36 in the form of one or more mathematical equations, charts, graphs, tables or the like, and in one illustrative embodiment it is implemented as a table of counter decrement rates, CDR, as a function of engine load, EL, or throttle percentage, T%.

In one illustrative embodiment, the counter decrement rate table is calibrated by operating the engine 12 at different engine load or throttle percentage values and recording the resulting engine warm-up times. The decrement count rate, CDR, values are calibrated to be inversely proportional to the recorded engine warm-up times, and are entered into the counter decrement rate table as a function of engine load, EL, or throttle percentage, T%.

Following step 130, algorithm execution advances to step 132 where control computer 36 is operable to decrement the diagnostic counter at a rate defined by the counter decrement rate, CDR. Thereafter at step 134, control computer 36 is operable to monitor a number of diagnostic abort conditions. Following step 134, control computer 36 is operable at step 136 to determine whether any of the diagnostic abort conditions have been satisfied by comparing each of the diagnostic abort parameters determined at step 134 to predefined operating conditions. In one embodiment, control computer 36 is operable at step 134 to monitor two diagnostic abort parameters; coolant temperature sensor out-of-range and the status of a run/halt diagnostic indicator. Control computer 36 is operable in a known manner to continually monitor the coolant temperature signal on signal path 42, and to maintain a number of coolant temperature fault indicators including, for example, in-range faults, out-of-range faults, and the like. In this embodiment, control computer 36 is operable at step 134 to monitor the coolant temperature sensor out-of-range fault indicator, and to determine that a diagnostic abort condition is satisfied if this fault indicator is true; i.e., if a coolant temperature sensor out-of-range fault condition exists.

Control computer 36 is further operable to maintain a run/halt diagnostic indicator that is set to "HALT" under certain operating conditions, and is otherwise set to "RUN". In one embodiment, for example, control computer 36 is operable to set the run/halt diagnostic indicator to "HALT" whenever any power-take-off (PTO) device is active, whenever a battery voltage out-of-range fault exists or whenever the engine state indicator is "STOP", and to otherwise set the run/halt diagnostic indicator to "RUN." In this embodiment, control computer 36 is operable in a known manner to continually monitor the battery voltage signal on signal path 54, and to maintain a number of battery voltage fault indicators including, for example, in-range faults, out-of-range faults, and the like. Control computer 36 is operable at step 134 to monitor the battery voltage sensor out-of-range fault indicator, and to set the run/halt diagnostic indicator to "HALT" if this fault indicator is true; i.e., if a battery voltage sensor out-of-range fault condition exists. Control computer 36 is further operable at step 134 to monitor the operational status of any of the PTO drive units and/or PTO functions described hereinabove, and to set the run/halt diagnostic indicator to "HALT" if any such PTO drive unit and/or PTO function is active. Control computer 36 is still further operable at step 134 to monitor the engine operating state flag or identifier described hereinabove, and to set the run/halt diagnostic indicator to "HALT" if the engine operating state indicator is "STOP." Control computer 36 is operable to set the run/halt diagnostic indicator to "RUN" under all other operating conditions.

At step 136, control computer 36 is operable to determine that a diagnostic abort condition is satisfied if a coolant temperature sensor out-of-range fault exists or if the run/halt diagnostic indicator is set to "HALT." On the other hand, control computer 36 is operable to determine that no diagnostic abort condition is satisfied if no coolant temperature sensor out-of-range fault exists and if the run/halt diagnostic indicator is set to "RUN." In any case, if control computer 36 determines at step 136 that any one or more of the foregoing diagnostic abort conditions are satisfied, control computer 36 is thereafter operable at step 138 to abort the diagnosis of the engine cooling system 32 by setting the cooling system diagnostic status flag to ABORT, and thereafter at step 140 to return algorithm 100 to its calling routine. Those skilled in the art will recognize that algorithm 100 may be easily modified to implement more or fewer diagnostic abort parameters and conditions, and/or more or fewer "HALT" definitions for the run/halt diagnostic indicator, and any such modifications are intended to fall within the scope of the claims appended hereto.

If control computer 36 determines at step 136 that none of the diagnostic abort conditions are satisfied, algorithm execution advances to step 142 where control computer 36 is operable to determine the current engine coolant temperature, CT, by monitoring the coolant temperature signal produced by coolant temperature sensor 40. Thereafter at step 144, control computer 36 is operable to determine whether the current coolant temperature, CT, is greater than the predefined coolant temperature, PCT (see equation (2)), or if the count value of the diagnostic counter has reached zero. If the coolant temperature, CT, is less than the predefined coolant temperature, PCT and if the count value of the diagnostic counter is not equal to zero, algorithm 100 loops back to step 128. If, on the other hand, control computer 36 determines at step 144 that the coolant temperature, CT, has met or exceeded the predefined coolant temperature, PCT, or that the count value of the diagnostic counter has reached zero, either condition indicates the end of the diagnostic period defined by the control loop of steps 128–144 and algorithm execution advances to step 146 where control computer 36 is operable to again determine the total fuel delivered, TFD2. Thereafter at step 148, control computer 36 is operable to determine the total energy used, TE, during the diagnostic period defined by the control loop of steps 128–144 as a difference between the total fuel delivered value, TFD2, after this control loop is complete and the total fuel delivered value, TFD1, before this control loop began.

As described briefly hereinabove, control computer 36 is operable in one illustrative embodiment to accumulate, as a continual function of the fuel delivery commands, the total fuel delivered, TFD, to the engine 12 for each engine operating cycle from engine start to engine stop. The difference between the TFD value just after completion of the diagnostic loop defined by steps 128–144 and the TFD value just before this control loop thus defines the total fuel used by engine 12 during the diagnostic period defined by the diagnostic loop comprising steps 128–144. In an alternative embodiment of algorithm 100, steps 126, 146 and 148 may be omitted, and a fuel usage monitoring step may be inserted into the diagnostic loop comprising steps 128–144, wherein such a fuel usage monitoring step continually tracks the amount of fuel delivered to engine 12 and thus accumulates a total fuel delivered value corresponding thereto, as a function of the fuel delivery commands, for the duration of the diagnostic loop. Any modifications to algorithm 100 required to effectuate such an alternative embodiment would be a mechanical step to a skilled artisan. This alternate embodiment, and any other known technique for determining the amount of fuel used during the diagnostic loop comprising steps 128–144, is intended to fall within the scope of the claims appended hereto.

Following step 148, algorithm execution advances to step 150 (FIG. 2C) where control computer 36 is operable to determine whether the most recent coolant temperature value, CT, determined at the last execution of step 142 is greater than or equal to the predefined coolant temperature, PCT. If so, then the diagnostic period defined by the diagnostic loop comprising steps 128–144 ended as a result of the coolant temperature, CT, meeting or exceeding the predefined coolant temperature, PCT, and algorithm execution then advances to step 152 where control computer 36 is operable to compare the total energy value, TE, computed at step 148 to the estimated energy value, EE, computed at step 116. If control computer 36 determines at step 152 that TE is less than EE, this indicates that the actual energy used by engine 12 to raise the coolant temperature from its initial value, ICT, to the predefined value, PCT, did not exceed the estimated energy required to effectuate this temperature rise, and that the engine 12 therefore warmed up in a reasonable amount of time using a reasonable amount of fuel. In this case, algorithm execution then advances to step 154 where control computer 36 is operable to set the cooling system diagnostic status flag to PASS, thereby indicating that the cooling system 32, including the engine thermostat 34, is operating normally. Algorithm execution thereafter advances to step 156 where control computer 36 returns algorithm 100 to its calling routine.

If, at step 150, control computer 36 determines that the coolant temperature, CT, determined at the last execution of step 142 is less than the predefined coolant temperature, PCT, then the diagnostic period defined by the diagnostic loop comprising steps 128–144 ended as a result of the diagnostic timer timing out before the coolant temperature reached the predefined coolant temperature, PCT. In this case, algorithm execution advances to step 158 where control computer 36 is operable to compare the total energy value, TE, computed at step 148 to the minimum energy value, ME, computed at step 118. If, at step 158, control computer 36 determines that the total energy, TE, is less than the minimum energy, ME, this indicates that the engine 12 was idling for an extended portion of the diagnostic period defined by steps 128–144, and algorithm execution accordingly advances to step 168 where control computer 36 is operable to set the cooling system diagnostic status flag to ABORT. Algorithm 100 advances from step 168 to step 170 where control computer 36 returns algorithm 100 to its calling routine.

If control computer 36 determines at step 158 that the total energy, TE, is greater than or equal to the minimum energy, ME, this indicates that the diagnostic period defined by steps 128–144 ended as a result of the diagnostic timer timing out, but that the engine 12 was not idling for an extended portion of the diagnostic period. If control computer 36 determines at step 152 that the total energy, TE, is greater than or equal to the estimated energy, EE, this indicates that the diagnostic period defined by steps 128–144 ended as a result of the coolant temperature, CT, exceeding the predefined coolant temperature, PCT, but that the actual energy used by engine 12 to increase the coolant temperature from its initial value, ICT, to the predefined value, PCT, exceeded the estimated energy required to effectuate this temperature rise. Either of these foregoing combinations of conditions are indicative generally of a failed cooling system 32, and specifically of a failed thermostat 34, and algorithm execution accordingly advances from the "no" branches of either of steps 152 and 158 to step 160 where control computer 36 is operable to monitor a number of do-not-log fault conditions. Following step 160, control computer 36 is operable at step 162 to determine whether any of the do-not-log fault conditions have been satisfied by comparing each of the number of do-not-log fault parameters determined at step 160 to predefined operating conditions.

In one embodiment, control computer 36 is operable at step 160 to monitor four do-not-log fault parameters; warm start, battery temperature out-of-range fault, coolant temperature sensor in-range fault, and battery temperature decrease following engine start-up. Control compute 36 is operable in a known manner to continually monitor the battery temperature, BT, on signal path 58 and the coolant temperature, CT, signal on signal path 42, and to maintain fault indicators for each including, for example, in-range faults, out-of-range faults, and the like. In this embodiment, control computer 36 is operable at step 160 to monitor battery temperature out-of-range and coolant temperature sensor in-range fault indicators, and to determine that a do-not-log fault condition is satisfied if either of these fault indicators are true; i.e., that either a battery temperature out-of-range fault or coolant temperature sensor in-range fault condition exists. Control computer 36 is further operable at step 160 to compute a difference between the coolant temperature, CT, and battery temperature, BT, at engine start up, and to determine that a "warm start" condition exists, and therefore that a do-not-log fault condition is thus satisfied, if this temperature difference is greater than a predefined temperature value, e.g., 10° F. Control computer 36 is still further operable at step 160 to monitor the battery temperature, BT, for a time period, P, following engine start up. If the battery temperature, BT, decreases by more than a predefined temperature amount, e.g., 10° F., following engine start up, this indicates that the engine 12 is moving toward a colder environment, and control computer 36 is accordingly operable to determine that a do-not-log fault condition exists.

In any case, if control computer 36 determines at step 162 that any one or more of the foregoing do-not-log fault conditions are satisfied, algorithm execution advances to step 168 where control computer 36 is operable to abort the diagnosis of the cooling system 32 by setting the cooling system diagnostic status flag to ABORT. If, on the other hand, control computer 36 determines at step 162 that none of the foregoing do-not-log fault conditions are satisfied, algorithm execution advances to step 164 where control computer 36 is operable to diagnose the cooling system 32 as failing by setting the cooling system diagnostic status flag to FAIL. Alternatively or additionally, control computer 36 may be operable at step 164 to diagnose the cooling system 32 as failing by identifying the engine thermostat 34 as a malfunctioning or failing. In any case, algorithm execution thereafter advances to step 166 where control computer 36 is operable to return algorithm 100 to its calling routine. Those skilled in the art will recognize that algorithm 100 may be easily modified to implement more or fewer do-not-log fault parameters and conditions, and any such modifications are intended to fall within the scope of the claims appended hereto.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. For example, while the diagnostic counter has been described hereinabove with respect to algorithm 100 as first being set to an initial count value as a function of the initial coolant temperature value, and thereafter being decremented at a decrement rate defined by engine load or throttle percentage, those skilled in the art will recognize that the diagnostic counter may alternatively be first set to zero or some other value, and thereafter incremented to a predefined or dynamically determined count value, e.g., as a function of initial coolant temperature, ICT, at an increment rate defined as a function of engine load or throttle percentage. Any modifications to algorithm 100 to effectuate such an alternative counter configuration would be a mechanical step to a skilled artisan.

What is claimed is:

1. System for diagnosing operation of a cooling system for an internal combustion engine, comprising:

a coolant temperature sensor producing a coolant temperature signal corresponding to temperature of coolant fluid in said cooling system;

means for determining one of an engine load and a throttle percentage; and a control computer diagnosing operation of said cooling system as a function of said coolant temperature signal, said one of an engine load and a throttle percentage and a fuel delivery command for controllably supplying fuel to said engine.

2. The system of claim 1 further including a key switch for starting and stopping said engine;

wherein said control computer is configured to monitor said coolant temperature signal to determine an initial coolant temperature when said key switch switches from an off to an on position.

3. The system of claim 2 wherein said control computer is configured to determine an estimated energy as a function of said initial coolant temperature, said estimated energy corresponding to an estimated quantity of energy required to increase said initial coolant temperature to a predefined higher coolant temperature.

4. The system of claim 3 wherein said control computer is configured to determine an initial count value of a diagnostic counter as a function of said initial coolant temperature.

5. The system of claim 4 further including means for determining an operating status of said engine and producing an engine operating status signal corresponding thereto;

wherein said control computer is responsive to said engine operating status signal indicating that said engine is running to begin a diagnostic period by determining a current value of said one of an engine load as a function of said fuel delivery command and a throttle percentage as a function of a requested torque value, determining a counter decrement rate as a function of said current value of said one of an engine load and a throttle percentage and decrementing said diagnostic counter from said initial count value at said counter decrement rate.

6. The system of claim 5 wherein said control computer is configured to continually monitor said coolant temperature signal, determine said current value of said one of an engine load and a throttle percentage, determine said counter decrement rate as said function of said current value of said one of an engine load and a throttle percentage, and decrement said diagnostic counter at said counter decrement rate until said diagnostic period ends by either of said coolant temperature signal meeting or exceeding said predefined coolant temperature and said diagnostic counter reaching zero.

7. The system of claim 6 wherein said control computer is configured to determine as a function of said fuel delivery command a total energy used by said engine during said diagnostic period.

8. The system of claim 7 wherein said control computer is configured to diagnose said cooling system, after expiration of said diagnostic period, as normally operating if said diagnostic period ended by said coolant temperature signal meeting or exceeding said predefined coolant temperature and if said total energy used by said engine during said diagnostic period is less than said estimated energy.

9. The system of claim 8 wherein said control computer is configured to diagnose said cooling system as failing if said total energy used by said engine during said diagnostic period otherwise meets or exceeds said estimated energy.

10. The system of claim 9 wherein said cooling system includes a thermostat having an open position allowing circulation of said coolant fluid therethrough, and a closed position inhibiting circulation of said coolant fluid therethrough;

and wherein said control computer is configured to diagnose said cooling system as failing by diagnosing said thermostat as a failed thermostat.

11. The system of claim 9 wherein said control computer is further configured to diagnose said cooling system as said failing only if no do-not-log fault conditions exist.

12. The system of claim 11 wherein said control computer is configured to otherwise abort diagnosis of said cooling system if any of said do-not-log fault conditions exist.

13. The system of claim 7 wherein said control computer is configured to determine a minimum energy as a function of said initial coolant fluid temperature, said minimum energy corresponding to a predicted quantity of energy that will be used by said engine if said engine runs at an idle speed during for an extended portion of said diagnostic period;

and wherein said control computer is configured to diagnose said cooling system, after expiration of said diagnostic period, as failing if said diagnostic period ended by said diagnostic counter reaching zero and if said total energy used by said engine during said diagnostic meets or exceeds said minimum energy.

14. The system of claim 13 wherein said cooling system includes a thermostat having an open position allowing circulation of said coolant fluid therethrough, and a closed position inhibiting circulation of said coolant fluid therethrough;

and wherein said control computer is configured to diagnose said cooling system as failing by diagnosing said thermostat as a failed thermostat.

15. The system of claim 13 wherein said control computer is configured to abort diagnosis of said cooling system if said total energy is otherwise less than said minimum energy.

16. The system of claim 13 wherein said control computer is configured to diagnose said cooling system as said failing only if no do-not-log fault conditions exist.

17. The system of claim 16 wherein said control computer is configured to otherwise abort diagnosis of said cooling system if any of said do-not-log fault conditions exist.

18. The system of claim 2 wherein said control computer is responsive to said key switch switching from said off to said on position to monitor a number of operating parameters associated with said engine, said control computer aborting diagnosis of said cooling system if any of said number of operating parameters associated with said engine are indicative of a diagnostic aborting condition.

19. The system of claim 6 wherein said control computer is further configured to continually monitor a number of operating parameters associated with said engine, said control computer aborting diagnosis of said cooling system if any of said number of operating parameters associated with said engine are indicative of a diagnostic aborting condition.

20. System for diagnosing operation of a cooling system for an internal combustion engine, comprising:

means for determining a temperature of coolant fluid in said cooling system;

means for determining an estimated energy as a function of an initial value of said temperature of said coolant fluid prior to a diagnostic period, said estimated energy corresponding to an estimated quantity of energy required to increase said temperature of said coolant fluid from said initial value to a predefined higher temperature value;

means for determining a total energy as a function of fuel quantity delivered to said engine during said diagnostic period, said total energy corresponding to a total quantity of energy used by said engine during said diagnostic period; and means for diagnosing said cooling system as operating normally if, after expiration of said diagnostic period, said temperature of said coolant fluid meets or exceeds said predefined temperature value and said total energy is less than said estimated energy.

21. The system of claim 20 further including means for diagnosing said cooling system as a failing if, after expiration of said diagnostic period, said total energy otherwise meets or exceeds said estimated energy and no do-not-log fault conditions exist.

22. The system of claim 21 wherein said cooling system includes a thermostat having an open position allowing circulation of said coolant fluid therethrough, and a closed position inhibiting circulation of said coolant fluid therethrough;

and wherein said means for diagnosing said cooling system as failing includes means for diagnosing said thermostat as a failed thermostat.

23. The system of claim 20 further including means for aborting diagnosis of said cooling system if, after expiration of said diagnostic period, said total energy otherwise meets or exceeds said estimated energy and at least one do-not-log fault condition exists.

24. The system of claim 20 further including:

means for determining an initial count value of a counter as a function of said initial value of said temperature of said coolant fluid;

means responsive to detection that said engine is running to start said diagnostic period;

means for continually monitoring said temperature of said coolant fluid, determining a current value of one of engine load as a function of engine fueling and a throttle percentage as a function of a driver requested torque value, determining a counter decrement rate as a function of said current value of said one of engine load and throttle percentage, and decrementing said counter at said counter decrement rate; and means for ending said diagnostic period if either of said temperature of said coolant fluid meets or exceeds said predefined temperature value and said counter reaches zero.

25. System for diagnosing operation of an engine cooling system for an internal combustion engine, comprising:

means for determining a temperature of coolant fluid in said cooling system;

means for determining a minimum energy as a function of an initial value of said temperature of said coolant fluid prior to a diagnostic period, said minimum energy corresponding to a predicted quantity of energy that will be used by said engine if said engine runs at an idle speed for an extended portion of said diagnostic period;

means for determining a total energy as a function of fuel quantity delivered to said engine during said diagnostic period, said total energy corresponding to a total quantity of energy used by said engine during said diagnostic period; and means for diagnosing said cooling system as a failing if, after expiration of said diagnostic period, said temperature of said coolant fluid is below a threshold temperature and said total energy meets or exceeds said minimum energy.

26. The system of claim 25 wherein said cooling system includes a thermostat having an open position allowing circulation of said coolant fluid therethrough, and a closed position inhibiting circulation of said coolant fluid therethrough;

and wherein said means for diagnosing said cooling system as failing includes means for diagnosing said thermostat as a failed thermostat.

27. The system of claim 25 further including means for otherwise aborting diagnosis of said engine cooling system if, after expiration of said diagnostic period, said total energy is less than said minimum energy.

28. The system of claim 25 further including means for aborting diagnosis of said cooling system if, after expiration of said diagnostic period, at least one do-not-log fault condition exists.

29. The system of claim 25 further including:

means for determining an initial count value of a counter as a function of said initial value of said temperature of said coolant fluid;

means responsive to detection that said engine is running to start said diagnostic period;

means for continually monitoring said temperature of said coolant fluid, determining a current value of said one of engine load as a function of engine fueling and a throttle percentage as a function of a driver requested torque value, determining a counter decrement rate as a function of said current value of said one of engine load and throttle percentage, and decrementing said counter at said counter decrement rate; and means for ending said diagnostic period if either of said temperature of said coolant fluid meets or exceeds a predefined temperature value and said counter reaches zero.

* * * * *